US007564984B2

(12) United States Patent
Bank et al.

(10) Patent No.: US 7,564,984 B2
(45) Date of Patent: Jul. 21, 2009

(54) ACOUSTIC DEVICE

(75) Inventors: Graham Bank, Suffolk (GB); Andrew Marchant, Cambridgeshire (GB); Martin Colloms, London (GB); Paul Burton, Cambridgeshire (GB)

(73) Assignee: New Transducers Limited, Huntingdon Cambs (GB)

( * ) Notice: Subject to any disclaimer, the term of this patent is extended or adjusted under 35 U.S.C. 154(b) by 402 days.

(21) Appl. No.: 10/565,370

(22) PCT Filed: Jul. 13, 2004

(86) PCT No.: PCT/GB2004/003038

§ 371 (c)(1),
(2), (4) Date: Feb. 28, 2006

(87) PCT Pub. No.: WO2005/015948

PCT Pub. Date: Feb. 17, 2005

(65) Prior Publication Data

US 2006/0227983 A1 Oct. 12, 2006

Related U.S. Application Data

(60) Provisional application No. 60/489,907, filed on Jul. 25, 2003.

(30) Foreign Application Priority Data

Jul. 24, 2003 (GB) ..... 0317331.7

(51) Int. Cl.
*H04R 25/00* (2006.01)
*H04R 11/02* (2006.01)

(52) U.S. Cl. ..... 381/152; 381/431

(58) Field of Classification Search ..... 381/152, 381/190, 423, 424, 425, 431
See application file for complete search history.

(56) References Cited

U.S. PATENT DOCUMENTS 6,456,723 B1 * 9/2002 Bank et al. ..... 381/425

FOREIGN PATENT DOCUMENTS

| | | | |
|---|---|---|---|
| EP | 0 065 810 | A | 12/1982 |
| WO | WO 97/09842 | A | 3/1997 |
| WO | WO 00/33612 | A | 6/2000 |
| WO | WO 00/78090 | A | 12/2000 |
| WO | WO 03/032679 | A2 | 4/2003 |

OTHER PUBLICATIONS

Harris et al., :Introduction to distributed mode loudspeakers (DML) with first-order behavioural modeling, *IEE Proceedings: Circuits Devices and Systems*, Institution of electric Engineers, Stenvenage, GB, vol. 147, No. 3, Jun. 8, 2000, pp. 153-157.

Bai et al., "Development of panel loudspeaker system: Design, evaluation and enhancement," *Journal of the Acoustical Society of America*, American Institute of Physics, New York, US, vol. 109, No. 6, Jun. 2001, pp. 2751-2761.

* cited by examiner

*Primary Examiner*—Brian Ensey
(74) *Attorney, Agent, or Firm*—Roylance, Abrams, Berdo & Goodman, L.L.P.

(57) ABSTRACT

A bending wave loudspeaker having an operating frequency range and a coincidence frequency which is above the operating frequency range, comprising a resonant panel having two generally orthogonal axes, vibration exciting means coupled to the panel to excite the panel into resonance along the one axis of the panel, and means restraining or preventing resonance along the other axis of the panel whereby the panel radiates an acoustic output which is of wide directivity along the one axis and of narrow directivity along the other axis of the panel.

15 Claims, 4 Drawing Sheets

ACOUSTIC DEVICE

This application claims the benefit of U.S. provisional application No. 60/489,907, filed July 25, 2003.

TECHNICAL FIELD

This invention relates to acoustic devices and more particularly to bending wave acoustic devices, e.g. loudspeakers.

BACKGROUND ART

Bending wave panel speakers, particularly Distributed Mode panel speakers, otherwise known by the achronym "DML", such as taught in WO 97/09842 and others to the present applicant, have the property of diffuse sound radiation resulting from complex bending wave action which beneficially provides wide directivity in all planes or directions. However in some applications a narrower directivity may be important, particularly in some axes or planes relative to others.

For public address purposes, for example for an airport concourse, the output of a loudspeaker is intended to be directed at the subjects. Maximum intelligible sound power is ideally directed over a specified range of height and over a wide horizontal area. If this narrower directivity requirement for the sound radiation in the vertical plane is not satisfactorily provided, sound power is wasted in driving the overall volume presented by the concourse and this wasted sound also degrades performance by echoing or reverberating around the space, degrading signal to noise ratio and reducing intelligibility.

Conventional piston/cone type line source speakers can achieve this to some degree, but suffer from significant interference between the arrays of piston elements at higher frequencies, which do not sum well in the acoustic space.

If the piston elements are then made smaller to address this issue, they have poorer low frequency output and power handling. If they are too large, the interference effects become dominant, spoiling the directivity performance. Compromises are therefore inevitable when using conventional piston drivers.

WO00/78090 to the present applicant describes a distributed mode bending wave panel speaker in which directivity in one plane is controlled by arranging the panel to have a modal axis and a non-modal axis orthogonal to the modal axis. The panel can support a plurality of resonant bending wave modes in the predetermined frequency range along the modal axis. The fundamental frequency of resonant bending wave modes along the non-modal axis is at least five times the fundamental frequency of the resonant bending wave modes along the modal axis. In this way, the sound emitted from the panel is anisotropic at frequencies where resonant bending wave modes along the modal axis, but not the non-modal axis, are excited.

The panel may be narrow, and of high aspect ratio and designed to operate with the intended bending wave modes dominant in the direction of the longer axis. There may be a span of vibration exciters across the minor axis to further encourage the modal dominance in the major axis. Such modes radiate over a wide range of angles relative to the long axis and hence if the panel is horizontally mounted a wide directivity is achieved in the horizontal plane. This is an advantage if such a speaker is mounted in this attitude above or below a video screen, and good area coverage may thus be provided to the audience.

Such a speaker is also intended to have wide directivity with respect to the minor axis. This is achieved because the high aspect ratio component of the invention consequently prescribes a relatively short minor axis, which radiates with naturally wide directivity at frequencies where it is modal.

However there is also a different requirement for a bending wave speaker with improved directional sound radiation, one which has particularly narrow directivity in one axis and simultaneously wide directivity in the other axis. A good application is public address.

DISCLOSURE OF INVENTION

According to the present invention, there is provided a loudspeaker comprising a bending wave loudspeaker having an operating frequency range and a coincidence frequency which is above the operating frequency range, comprising a resonant panel having two generally orthogonal axes, vibration exciting means coupled to the panel to excite the panel into resonance along the one axis of the panel, and means restraining or preventing resonance along the other axis of the panel whereby the panel radiates an acoustic output which is of wide directivity along the one axis and of narrow directivity along the other axis of the panel.

The vibration exciting means may also form the means restraining or preventing resonance along the panel. In this way, the length of the exciting means may be the key to controlling the directivity along the panel. The vibration exciting means is preferably longer than the wavelength of sound in air at the lowest required frequency. For example, for a public address speaker the line (and hence the length of the panel) should be at least 40 cm long, giving a lowest nominal controlled directivity frequency of no more than 850 Hz or so.

The vibration exciting means may comprise a line of discrete exciters extending along the panel and operated substantially in phase. The line may be rectilinear. The line may extend substantially from one short end of the panel to the other short end.

There are preferably at least four exciters in the line. Three exciters are unlikely to be sufficient to control the directivity along the panel without excessive off-axis interference and consequent lobing in the corresponding polar response. The upper limit to the number of exciters is determined only by the size of the panel.

The line of exciters may be on the median longitudinal axis of the panel or to one side of the median axis, e.g. on the nodal line of the first lateral bending mode. The exciters may be equally spaced along the line. The spacing between exciters should be less than the wavelength of sound in the panel (not in the air) at the highest frequency of operation. Since the panel material is a determining factor in the highest frequency of operation, the spacing will therefore depend on the panel material selected.

The panel may be rectangular, with a main or major axis, and correspondingly a cross or minor axis. The panel may have an aspect ratio (i.e. ratio of length to width) of at least 2:1. The panel length may be greater than the length of the exciter means. However, since the key to control directivity is the length of the exciter means, it is preferable for the exciter means to extend along the length of the panel.

The panel width may range from 8 cm-100 cm, particularly for use in a public address system. If the width is below 8 cm, the panel may not have sufficient low frequency bandwidth or output level to be effective. If the width is greater than 100 cm, the panel is likely to be impractical to handle and make.

The coincidence frequency of the panel is preferably approximately equal to or greater than the highest desired frequency. Otherwise, the vibration exciting means acting as the restraining means may produce strong off-axis lobing at the coincidence frequency which in turn may disrupt the reverberent sound-field in the acoustic space and reduce intelligibility.

In contrast to the teaching of WO00/78090, modes are encouraged for the minor cross axis to provide wide horizontal plane bending wave directivity when the rectangular panel is vertically orientated, as is common with public address speakers. Such an orientation also minimises mounting difficulties for architects and contractors. The speaker of the present invention may thus be considered to have the opposite acoustic effect of the speaker of WO00/78090. It is opposite both in principle and in action.

For the longer, major axis the bending wave panel provides a common surface for the extended source of excitation, which may be over a continuous line with a suitable force exciter, or may result from a line represented by an array of discrete exciters, suitably connected electrically. Viewed in respect of the major axis the panel diaphragm approximates to an energy summation surface representing an extended, semi-coherent acoustic source and consequently has the required property of significantly narrowed directivity in the vertical plane due to the size of the source compared with the radiated wavelength.

The shaping of the directivity of sound radiation with frequency may be adjusted by the designer by determining the size of the major and minor axes, and if multiple exciters are used the level, frequency and phase response of the electrical signals connected to the exciters. Control of the exciters may be by conventional analogue or digital means. Other factors include the bending stiffness of the panel with respect to panel size and bending axis.

The technique of adjusting the drive line length with frequency, using electrical frequency sensitive networks, may be used to fine tune the vertical directivity over the frequency range. For example, the line may be significantly larger, e.g. more than 10 times longer, than the wavelength of the highest desired frequency. In this case, the directivity along the panel will be focused into a very narrow beam and spatial coverage will be limited. It may thus be desirable to employ filters to progressively shorten the effective line length as the frequency increases.

BRIEF DESCRIPTION OF DRAWINGS

The invention is diagrammatically illustrated, by way of example, in the accompanying drawings, in which:—

BEST MODES FOR CARRYING OUT THE INVENTION

Figure 1:
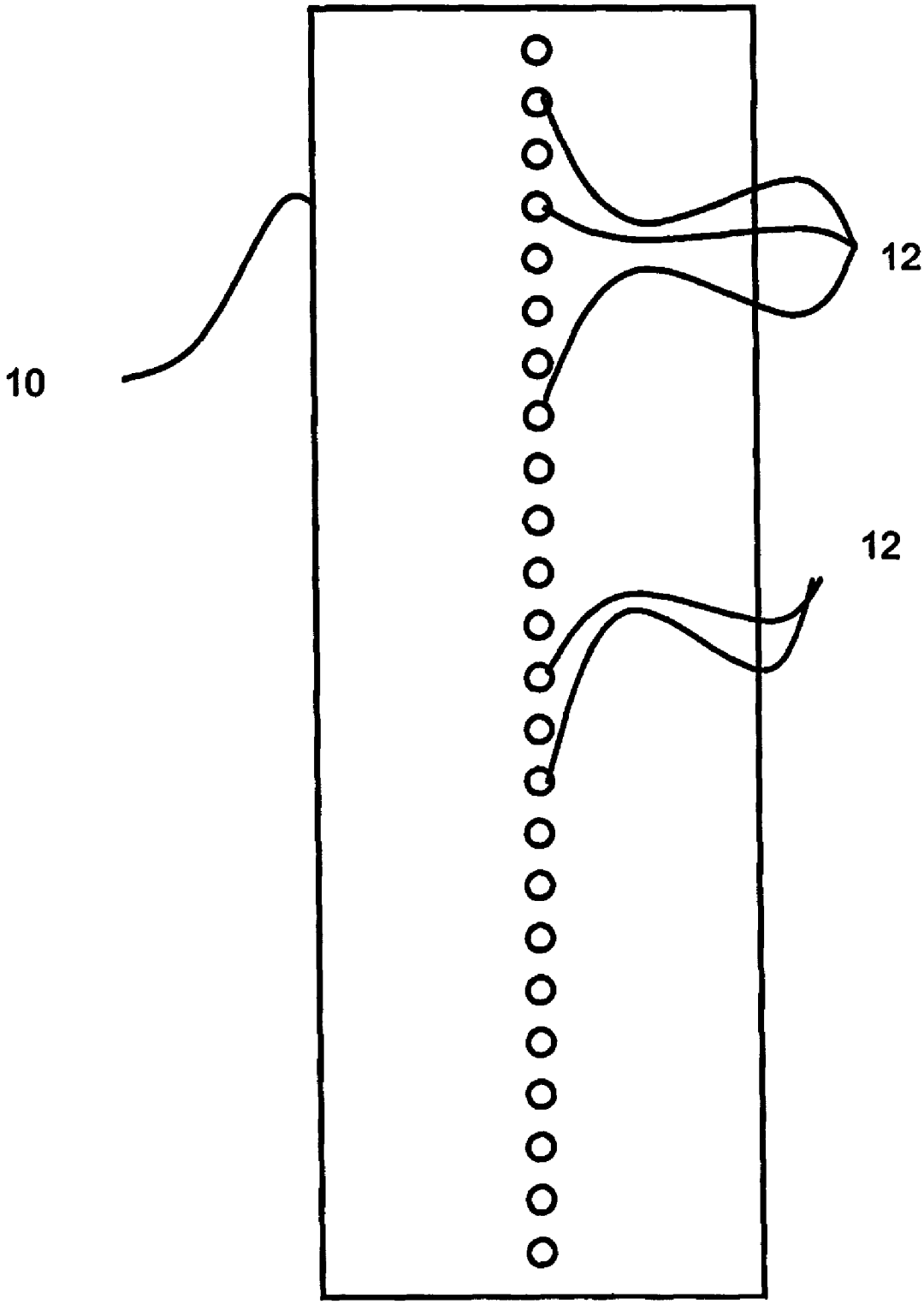
FIG. 1 is a plan view of a speaker according to a first aspect of the invention.
Figure 2:
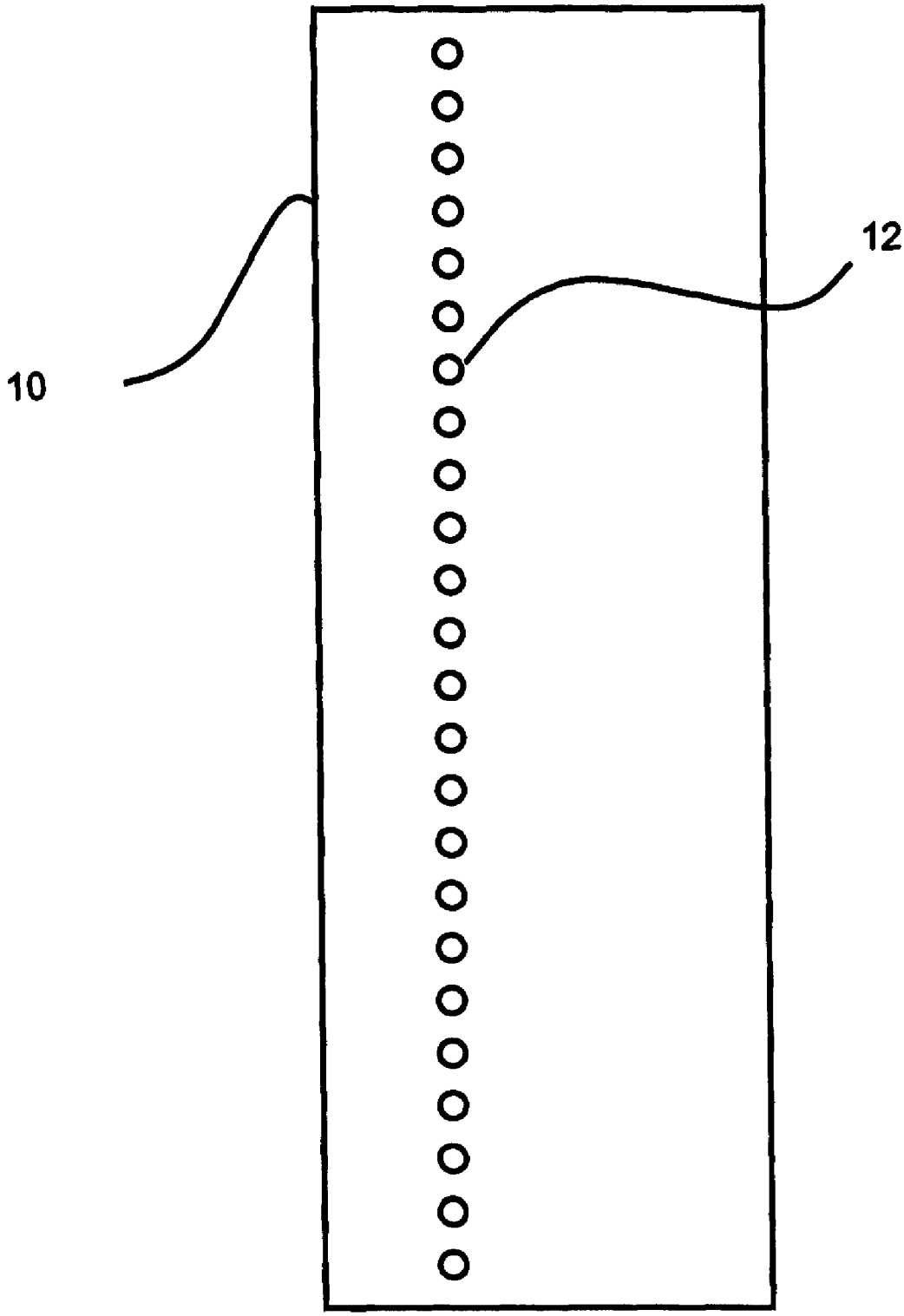
FIG. 2 is a plan view of a speaker according to a second aspect of the invention.

FIGS. 1 and 2 show a loudspeaker comprising a panel 10 to which an array of twenty-four exciters 12 are mounted to drive bending wave vibration in the panel. The panel is large having dimensions of 120 cm by 40 cm and thus has an aspect ratio of 3:1. Each exciter has a diameter of 25 mm and the array of exciters extends from one short end to the other short end of the panel.

In FIG. 1 the exciters 12 are equally spaced in a line running along the length of the long axis of the panel 10. In FIG. 2 the exciters 12 are equally spaced on an off-axis line running along the length of the panel 10. The off-axis line is the nodal line of the first lateral bending wave mode.

Figure 3:
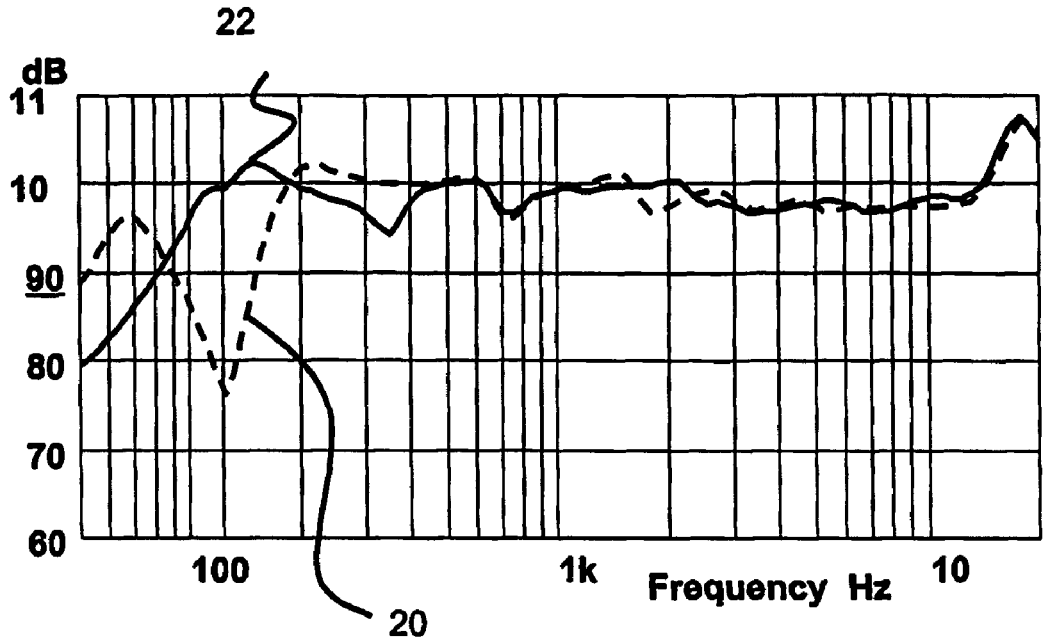
FIG. 3 is a graph of the simulated acoustic output (dB) against frequency (Hz) for the speakers of FIGS. 1 and 2 mounted in an infinite baffle.

FIG. 3 shows the simulated frequency responses 20, 22 for the loudspeakers of FIGS. 1 and 2 as solid and dashed lines respectively. The acoustic response of the loudspeaker of FIG. 1 has a significant drop in sound pressure level at the first resonant bending wave mode of the panel, namely at 100 Hz. By mounting the exciters along the nodal line for this mode, as in the loudspeaker of FIG. 2, this mode is excited and thus the frequency response is smoothed.

Figure 4A:
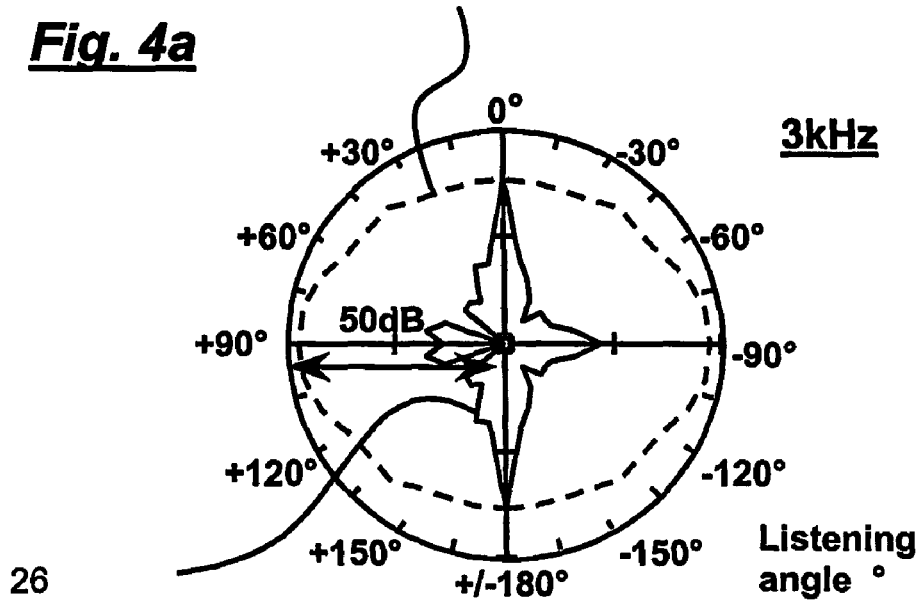
FIGS. 4*a* to 4*c* show the horizontal and vertical directivity of the speaker of FIG. 2 at 3 kHz, 1 kHz and 250 Hz respectively.
Figure 4B:
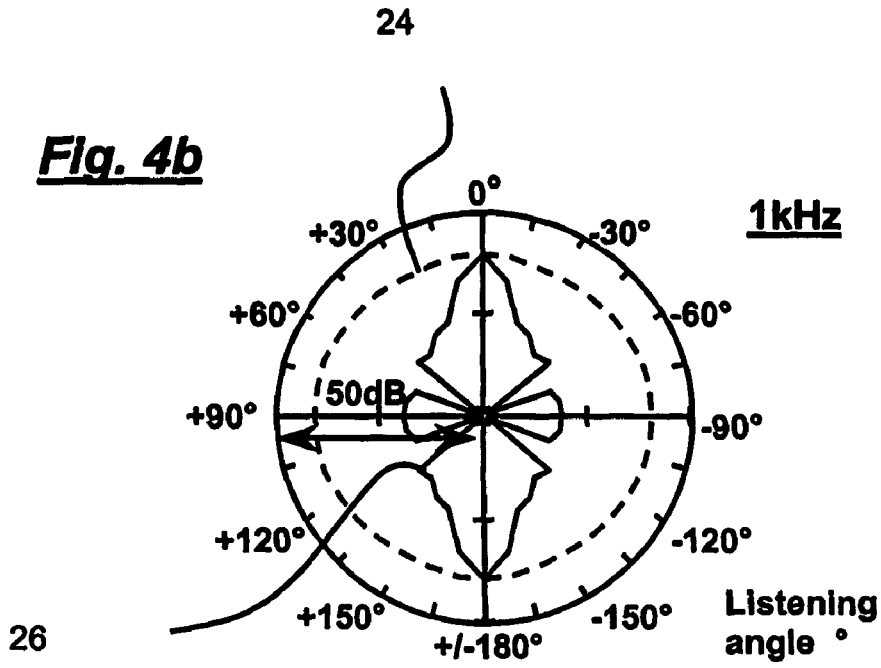
Figure 4C:
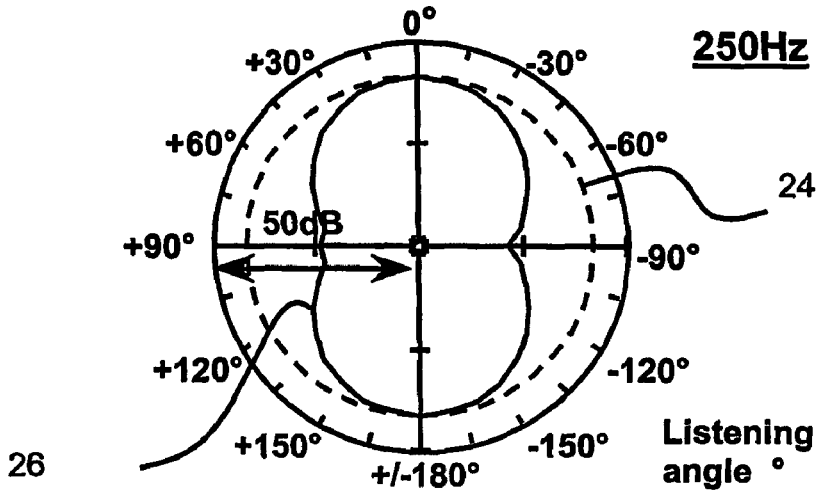

FIGS. 4*a* to 4*c* show the directivity 24, 26 in the planes passing through the short axis or long axis for the speaker of FIG. 2 as dashed and solid lines respectively. The directivity in the planes passing through the short and long axis is the directivity across and along the panel respectively. If the speaker is vertically mounted, i.e. mounted with its long axis vertically, the directivity in the plane passing through only the short axis may be considered to be the horizontal directivity. Similarly, the directivity in the plane passing through only the long axis may be considered to be the vertical directivity. The directivity in the plane of the panel is not considered.

The horizontal directivity is substantially uniform at 3 kHz and is perfectly uniform at 1 kHz and 250 Hz. In contrast, there is substantial beaming in the vertical directivity at 3 kHz and 1 kHz with peaks when the measurements are taken on the short axis. The output drops away rapidly and significantly as the measurements are taken off-axis. The directivity is more uniform at 250 Hz with the peaks on axis falling away more gently.

Thus the loudspeaker of FIG. 2 may be used as a public address system for speech with a controlled directivity range of 250-3 kHz. Above 3 kHz the beaming is too strong to provide good coverage. The panel size is close to the largest which provides good coverage in a large public space without frequency shading.

It is to be noted that the speaker of the present invention will only operate below the coincidence frequency of the panel.

Coincidence occurs when the wavespeed in the panel v is equal to the speed of sound in air c. (Note $v \propto \sqrt{f}$ while c is constant with frequency and at 20° C. is 343 $ms^{-1}$). From $v=\sqrt{2\pi f\sqrt{B/\mu}}$, $v=f\lambda$, $c=f\lambda$, with the constraint that at coincidence $c=v$:

$$f_{coincidence} = \frac{c^2}{2\pi\sqrt{\frac{B}{\mu}}} \text{ i.e. } f_{coincidence} \propto \frac{1}{\sqrt{\frac{B}{\mu}}}$$

Thus to maximise the coincidence frequency, $\sqrt{b/\mu}$ must be minimised. B is the bending stiffness of the panel, while μ is the areal density—thus a floppy, heavy panel is required.

It is also to be noted that the exciter spacing must not be greater than half the wavelength in the panel.

Consider a spacing of d between the centres of the exciters.

From $v=\sqrt{2\pi f\sqrt{b/\mu}}$, $v=f\lambda$, with the constraint that $$\frac{\lambda}{2}=d:f_{exciterspacing}=\frac{2\pi\sqrt{\frac{B}{\mu}}}{4d^2}\text{ i.e. }f_{exciterspacing}\propto\sqrt{\frac{B}{\mu}}$$

Thus to maximise the exciter spacing frequency, $\sqrt{b/\mu}$ must be maximised. B is the bending stiffness of the panel, while μ is the areal density—thus a stiff, light panel is required.

It can be seen that these two requirements conflict. Thus a balance must be made between a sufficiently heavy/floppy panel to have a high coincidence frequency, and a stiff/light panel with a maximised exciter spacing limit frequency. It would be expected that for an ideal material, these frequencies would be equal, giving $$f_{exciterspacing}=f_{coincidence}\text{ therefore }\frac{2\pi\sqrt{\frac{B}{\mu}}}{4d^2}=\frac{c^2}{2\pi\sqrt{\frac{B}{\mu}}}$$

This can be simplified to $$\frac{B}{\mu}=\left(\frac{cd}{\pi}\right)^2$$

Thus for a given exciter spacing d, a theoretically ideal ratio of bending stiffness B and areal density μ can be found. This is a very useful calculation when searching for suitable panel materials. It can certainly be said that using a material exhibiting a lower coincidence frequency than exciter spacing limit is unwise as the panel material will be restricting the performance of the speaker unnecessarily, hence this can be considered an upper limit for the ideal B/μ ratio.

In practice the exciter spacing limit does not appear to be as low as is predicted above, and as such a material with a higher coincidence frequency than exciter spacing limit frequency appears to work better. There is only evidence from simulations and experimental prototypes for this, however it is thought that the finite size of the exciters, since they are not point sources, is partially responsible. Additionally the speaker is likely to exhibit strong off axis lobes at the coincidence frequency, and moving these higher in frequency is likely to be beneficial. Thus materials with a B/μ ratio less than the upper limit above are very likely to be suitable.

Concerning the lower limit for the ideal B/μ ratio, a suggestion based purely on practical experience is to set the lower B/μ ratio limit at when the exciter spacing limit frequency equals half the coincidence frequency.

$$f_{exciterspacing}=\frac{f_{coincidence}}{2}\text{ therefore }\frac{2\pi\sqrt{\frac{B}{\mu}}}{4d^2}=\frac{c^2}{2\pi\sqrt{\frac{B}{\mu}}}\times\frac{1}{2}$$

This can be simplified to $$\frac{B}{\mu}=\frac{1}{2}\left(\frac{cd}{\pi}\right)^2$$

Or in other words half the B/μ ratio calculated above. Thus a range for the ideal B/μ ratio can be stated:

$$\left(\frac{cd}{\pi}\right)^2\geq\frac{B}{\mu}\geq\frac{1}{2}\left(\frac{cd}{\pi}\right)^2$$

Note however that this does not exclude panel materials outside this range from being used to build line array loudspeakers according to the invention, since there may be other aspects of the performance of the speaker to consider. Nevertheless, this is a suggested ideal range and straying outside of it is likely to restrict the maximum directional limit frequency.

A speaker according to the invention will have output above the coincidence frequency of the panel, but little or no control of its directivity will be possible at this point. Simulations show that lobing might be a problem, and as such it may be necessary to restrict the input frequencies to those at which the directivity of the panel is well controlled i.e. filter off the highest frequencies, that is those above the coincidence frequency and exciter spacing frequency limits, so the lobing does not become a problem. The upper frequency limits of the speaker are usually well above that necessary for speech and thus top end filtering can only increase intelligibility.

The length of the exciter array determines the limit of the directivity at low frequencies; the more exciters used, the longer the line, the lower the frequency at which the speaker will be directional. Couple this with the requirement for the exciters to be closely spaced and it can be seen that several exciters will be probably be required. However, this is not the only limitation to low-frequency performance. If the panel is too narrow, made from too stiff a material for its size, or the mounting scheme too stiff, the speaker may exhibit an abnormally high low frequency cut-off, as with any other DML.

In theory there are quite a few options as to how the exciters could be positioned, as it is the vertical spacing that is critical. There are combinations of the exciters either all in a line or staggered either side of a line, and on only one or both sides of the panel. Simulations show the performance is better with the exciters in a line; with staggered exciters there may be serious lobing problems in the vertical direction, and the horizontal directivity may also be poor. The barrier to the exciters being placed on both sides of the panel is one of aesthetics, and as such this has only been attempted in simulation. Of course in a normal DML panel, it is usual to choose the exciter position carefully in order to ensure a smooth frequency response, however in this present application freedom of exciter position is obviously not possible, and as the simulations suggest, electronic equalisation of the finished speaker may prove necessary.

The invention claimed is:

1. A bending wave loudspeaker having an operating frequency range and a coincidence frequency which is above the operating frequency range, comprising a resonant panel having a main or major axis and a cross or minor axis and an aspect ratio of at least 2:1, a plurality of vibration exciters coupled to the panel to excite the panel into resonance along the cross or minor axis of the panel, and means restraining or preventing resonance along the main or major axis of the panel whereby the panel radiates an acoustic output which is of wide directivity along the cross or minor axis and of narrow directivity along the main or major axis of the panel.

2. A loudspeaker according to claim 1, wherein the plurality of vibration exciters forms the means restraining or preventing resonance along the main or major axis.

3. A loudspeaker according to claim 2, wherein the length of the plurality of vibration exciters along the panel is longer than the wavelength of sound in air at the lowest required frequency.

4. A loudspeaker according to claim 2, wherein the plurality of vibration exciters comprises a line of discrete exciters extending along the main or major axis and operated substantially in phase.

5. A loudspeaker according to claim 4, wherein the spacing between the exciters is not greater than half the wavelength in the panel at the highest operating frequency.

6. A loudspeaker according to claim 4, wherein the line is rectilinear.

7. A loudspeaker according to claim 4, wherein the line extends substantially from one end of the panel to the other end.

8. A loudspeaker according to claim 4, wherein there are at east four exciters in the line.

9. A loudspeaker according to claim 4, wherein the line of exciters is to one side of the median longitudinal axis of the panel.

10. A loudspeaker according to claim 9, wherein the line is on the nodal line of the first lateral bending mode.

11. A loudspeaker according to claim 4, wherein the exciters are equally spaced along the line.

12. A loudspeaker according to claim 4, wherein the exciter spacing d in the line and the bending stiffness B and areal density μof the panel substantially conform to the formula:

$$\frac{B}{\mu} = \left(\frac{cd}{\pi}\right)^2.$$

13. A loudspeaker according to any one of claims 1 and 2-12, wherein the panel is rectangular.

14. A loudspeaker according to any one of claims 5 and 7 to 12, wherein the line is rectilinear.

15. A loudspeaker according to claim 14, wherein the panel is rectangular.

* * * * *